US012173977B2

(12) United States Patent
Wiggins et al.

(10) Patent No.: US 12,173,977 B2
(45) Date of Patent: Dec. 24, 2024

(54) BARREL NUT ASSEMBLY

(71) Applicant: Bowden Manufacturing Corporation, Willoughby, OH (US)

(72) Inventors: James William Wiggins, Rome, OH (US); Wesley Scott Holder, Mentor, OH (US); Adam Daniel Stark, Stow, OH (US)

(73) Assignee: BOWDEN MANUFACTURING CORPORATION, Willoughby, OH (US)

( * ) Notice: Subject to any disclaimer, the term of this patent is extended or adjusted under 35 U.S.C. 154(b) by 0 days.

(21) Appl. No.: 18/405,611

(22) Filed: Jan. 5, 2024

(65) Prior Publication Data

US 2024/0240902 A1 Jul. 18, 2024

Related U.S. Application Data

(60) Provisional application No. 63/479,608, filed on Jan. 12, 2023.

(51) Int. Cl.

| | |
|---|---|
| ***F41A 21/48*** | (2006.01) |
| ***F41A 17/54*** | (2006.01) |
| ***F41C 23/16*** | (2006.01) |

(52) U.S. Cl.

CPC ..... *F41A 21/48* (2013.01); *F41A 17/54* (2013.01); *F41C 23/16* (2013.01)

(58) Field of Classification Search

CPC ..... F41C 23/16; F41A 21/48; F41A 21/484; F41A 21/487

See application file for complete search history.

(56) References Cited

U.S. PATENT DOCUMENTS

| | | | | |
|---|---|---|---|---|
| 8,839,545 | B1 * | 9/2014 | Gangl | F41C 23/16 42/75.03 |
| 9,032,659 | B1 * | 5/2015 | Duneman | F41C 27/00 42/71.01 |
| 12,018,907 | B1 * | 6/2024 | Noonan | F41C 23/16 |
| 2007/0017139 | A1 * | 1/2007 | Larue | F41A 21/482 42/75.1 |
| 2011/0061281 | A1 * | 3/2011 | Kapusta | F41C 23/16 42/71.01 |
| 2012/0102805 | A1 * | 5/2012 | Buxton | F41C 23/16 411/378 |
| 2014/0076150 | A1 * | 3/2014 | Brinkmeyer | F41A 5/28 89/193 |
| 2015/0101232 | A1 * | 4/2015 | Schoenlau | F41C 23/16 42/90 |
| 2016/0187083 | A1 * | 6/2016 | Underwood | F41A 3/66 42/75.02 |
| 2017/0254610 | A1 * | 9/2017 | Hill | F16B 39/06 |
| 2019/0204040 | A1 * | 7/2019 | Mackey | F41A 21/481 |

(Continued)

FOREIGN PATENT DOCUMENTS

| | | | | |
|---|---|---|---|---|
| WO | WO-2016028908 | A1 * | 2/2016 | F41A 21/48 |

*Primary Examiner* — Gabriel J. Klein

(74) *Attorney, Agent, or Firm* — RANKIN, HILL & CLARK LLP

(57) ABSTRACT

A barrel nut assembly of a firearm. The barrel nut assembly includes a barrel nut configured for threaded attachment to an associated upper receiver of the firearm and a bushing that slidingly engages the barrel nut. The bushing threadingly engages an associated handguard of the firearm.

20 Claims, 8 Drawing Sheets

(56) References Cited

U.S. PATENT DOCUMENTS

| | | | | |
|---|---|---|---|---|
| 2019/0257615 | A1* | 8/2019 | Tubb | F41A 21/48 |
| 2020/0284543 | A1* | 9/2020 | Hull | F41A 21/482 |
| 2023/0221092 | A1* | 7/2023 | Underwood | F41A 21/48<br>42/71.01 |
| 2024/0240902 | A1* | 7/2024 | Wiggins | F41A 21/48 |

* cited by examiner

BARREL NUT ASSEMBLY

BACKGROUND

Handguards are utilized on many types of firearms for a variety of reasons. For example, handguard can provide for an improved grip for the user of the firearm. Further, the handguard also provides protection to the user, by isolating some of the heat that can be generated by a barrel during operation of the firearm.

A barrel nut can be used to connect a barrel and an upper receiver of a firearm together. In particular, the barrel can be partially slid through the barrel nut and the barrel nut can threadably engage the upper receiver. Then, a handguard can be installed over the barrel and threadably connected to the barrel nut to join the handguard to the upper receiver of the firearm. As will be understood, the upper receiver and the handguard can each include a picatinny rail.

However, barrel nuts are not easily aligned with the upper receiver, thereby resulting in gaps between the handguard and the upper receiver. Further, there can be a lack of rotational alignment between the handguard and the upper receiver, resulting in the respective picatinny rails of the handguard and the upper receiver being out of alignment, and hence unusable. Accordingly, a better arrangement is needed.

SUMMARY

In view of the foregoing, a barrel nut assembly includes a barrel nut configured for threaded attachment to an associated upper receiver of the firearm and a bushing that slidingly engages the barrel nut. The bushing threadingly engages an associated handguard of the firearm.

According to an aspect, a method of assembling a system includes sliding a barrel through a bushing, a spring, and a barrel nut, tightening the barrel nut to an upper receiver of a firearm and rotating the bushing with respect to the barrel nut so as to define a first rotational position.

DETAILED DESCRIPTION

It should, of course, be understood that the description and drawings herein are merely illustrative and that various modifications and changes can be made in the structures disclosed without departing from the present disclosure.

Figure 1:
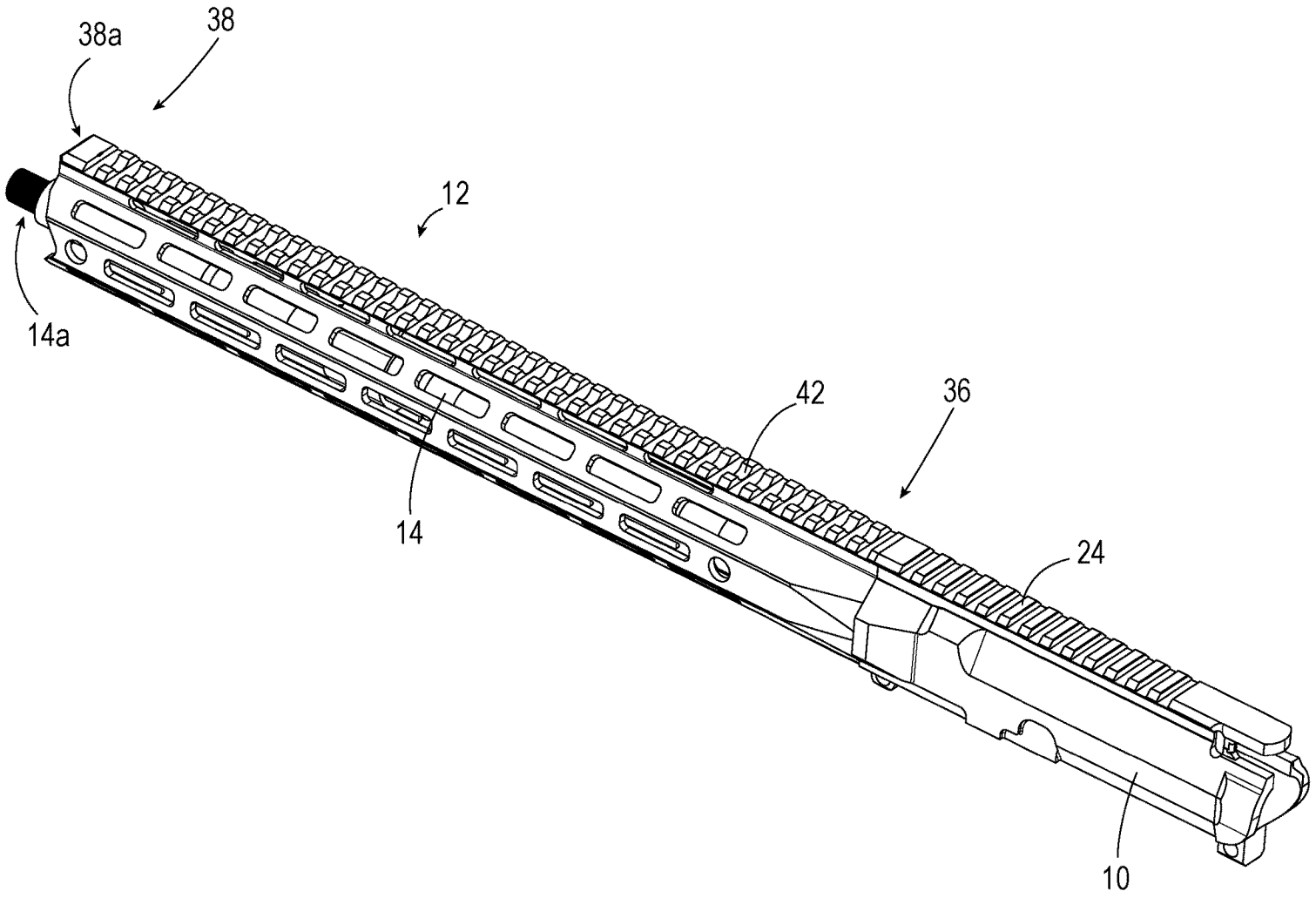
FIG. 1 is a right perspective view of a handguard attached to an upper receiver of a firearm.
Figure 2:
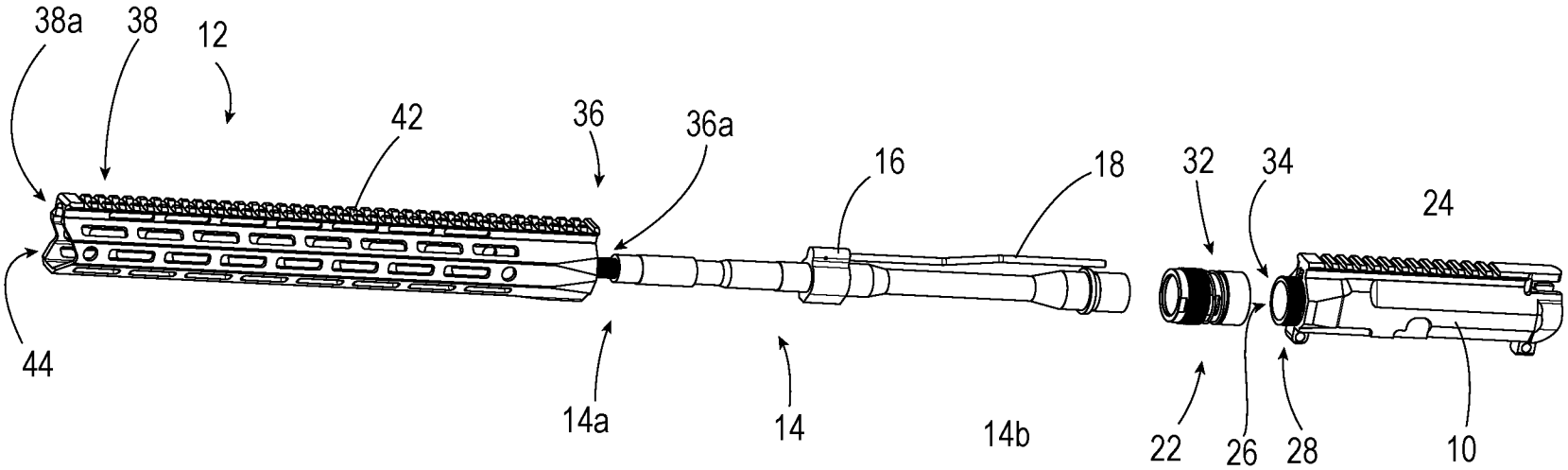
FIG. 2 is an exploded left perspective view of FIG. 1.
Figure 3:
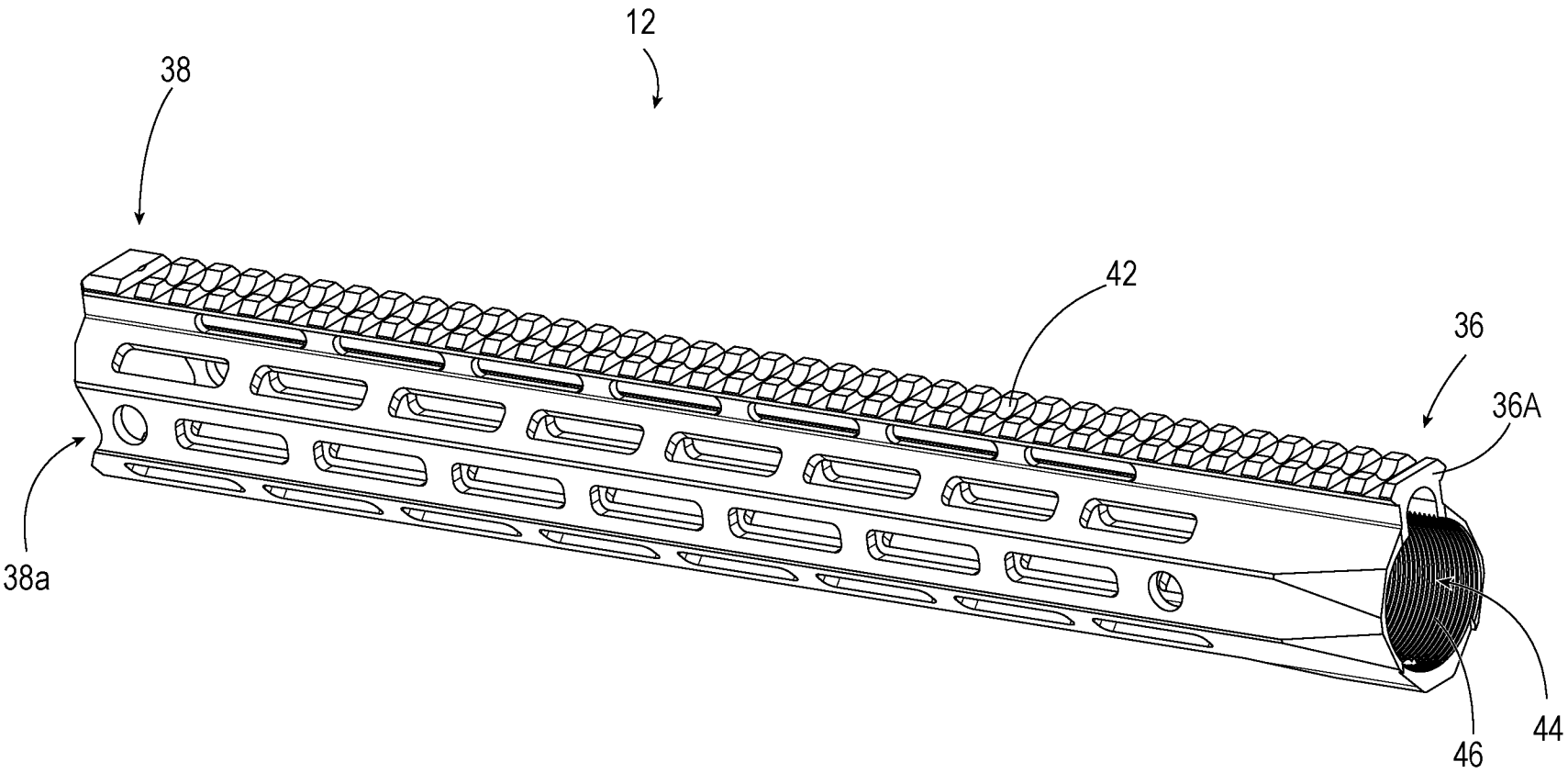
FIG. 3 is a left perspective view of a handguard.
Figure 4:
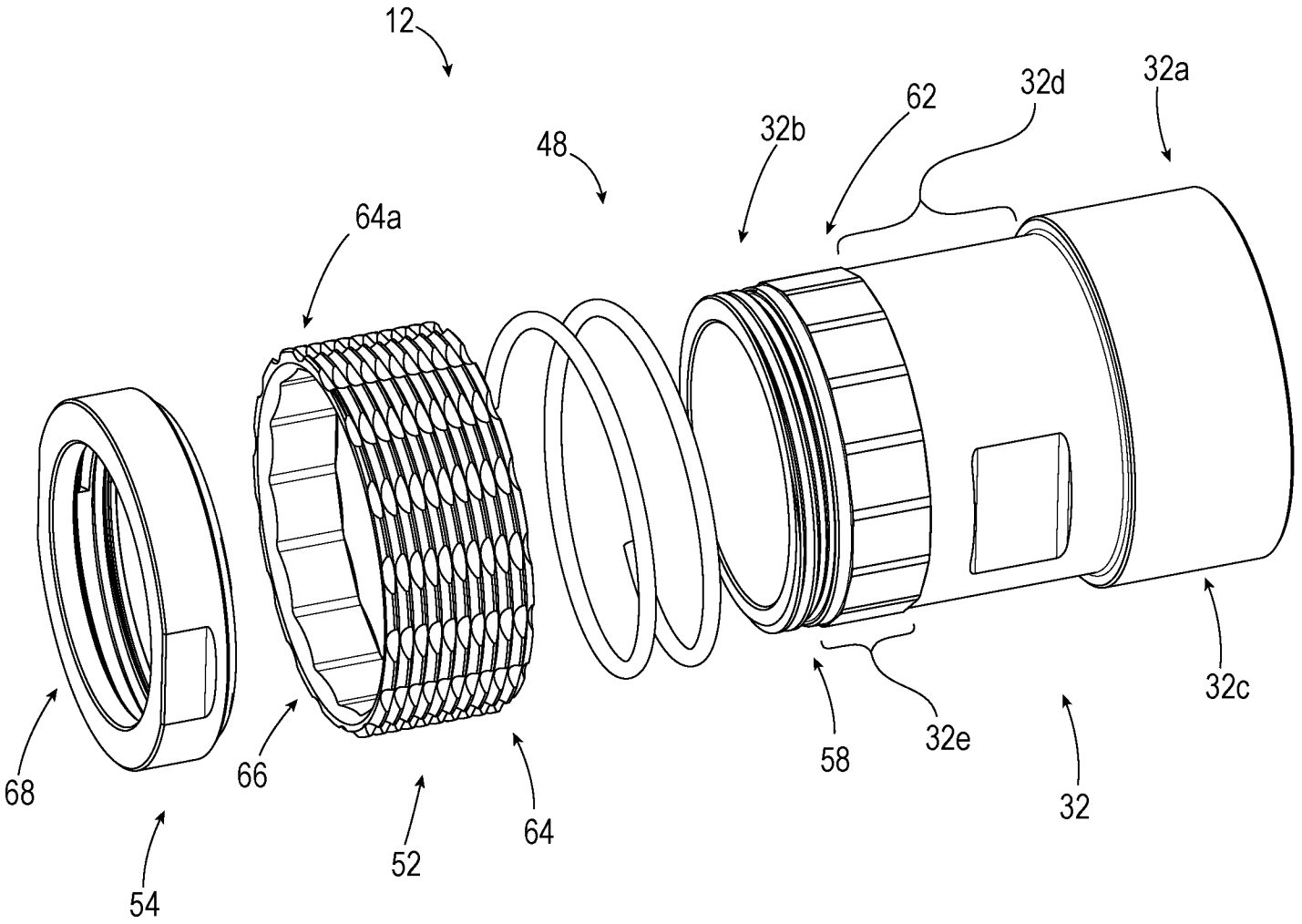
FIG. 4 is a left perspective view of a barrel nut assembly.
Figure 5:
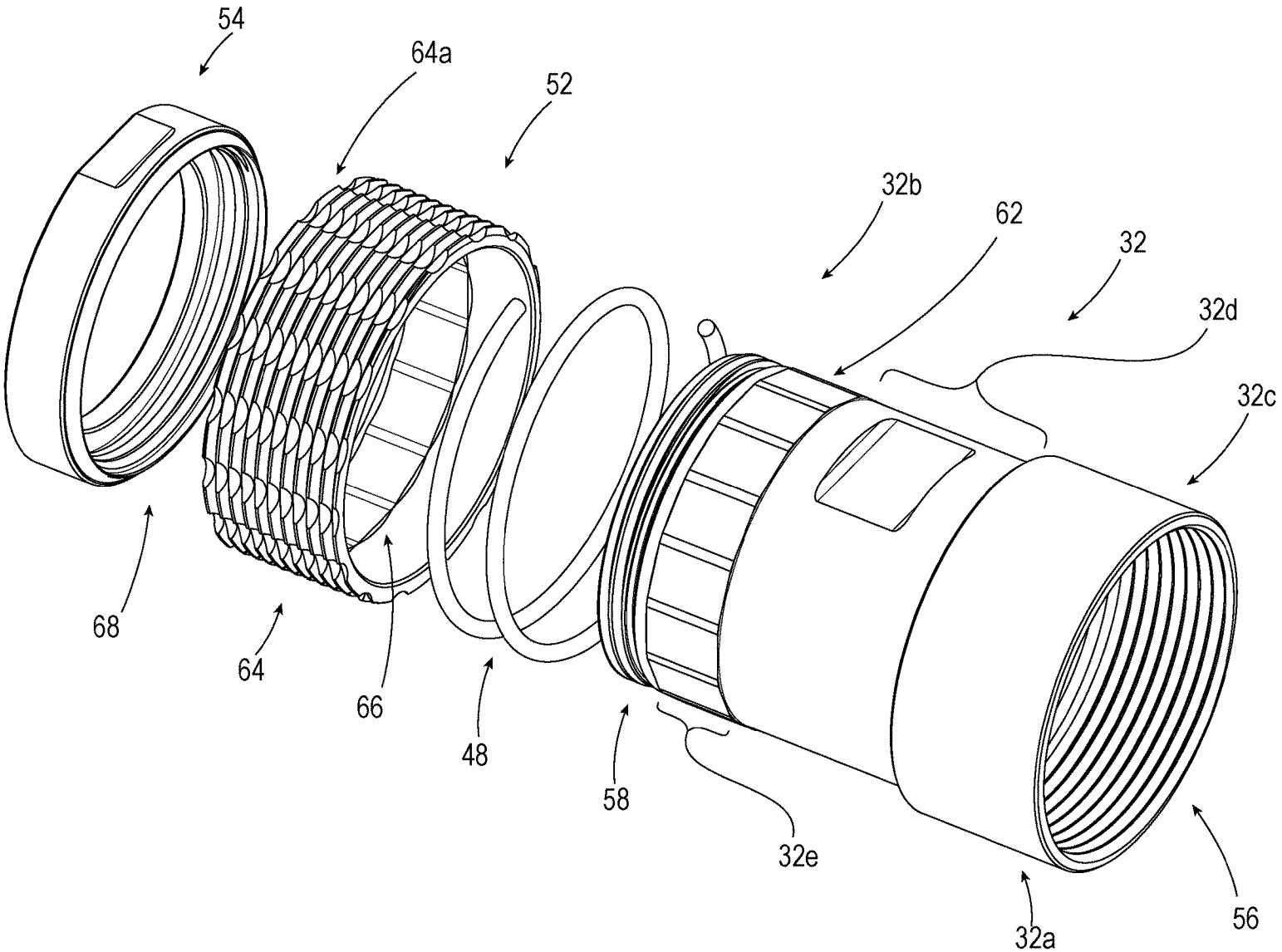
FIG. 5 is a right perspective view of the barrel nut assembly of FIG. 4.

With reference to the figures, and specifically, FIGS. 1-3, an upper receiver 10, a handguard 12, a barrel 14, a gas block 16, a gas tube 18, and a barrel nut assembly 22 are shown. For brevity, only the upper receiver 10 of a firearm is shown, but it will be appreciated that the upper receiver 10 is merely a part of an entire receiver of a firearm as is known in the art.

The upper receiver 10 can include a rail portion 24, a gas port 26, and a threaded boss 28. The gas port 26 receives the gas tube 18 and the threaded boss 28 can slidably receive the barrel 14 and threadingly engage a barrel nut 32 of the barrel nut assembly 22. Further, the upper receiver 10 includes a front face 34 that faces toward the handguard 12.

The handguard 12 can include a rear end 36 with a rear side 36*a* that faces the front face 34 of the upper receiver 10 and a front end 38 with a front side 38*a* that faces in a direction opposite of the rear side 36*a*. Additionally, the handguard 12 can include a rail section 42. Further, the handguard 12 can define a barrel tunnel 44 that receives the barrel 14. As shown in FIG. 1, the rail section 42 can be continuous with the rail portion 24 of the upper receiver 10 when the handguard 12 is fully installed on the upper receiver 10. Further, the handguard 12 can define internal threads 46 near the rear end 36 for engagement with the barrel nut assembly 22 as will be described in more detail hereinafter.

The barrel 14 can include a muzzle end 14*a* and a breech end 14*b* that are disposed at opposite ends. The muzzle end 14*a* may be threaded to receive a variety of sound and/or flash suppressing devices without departing the scope of this disclosure. The breech end 14*b* can be slidably received within the upper receiver 10 as is known in the art.

Further, the gas block 16 can be removably mounted to the barrel 14 so as to prevent rotation of the gas block 16 around the barrel 14. The gas tube 18 can extend between the gas block 16 and the upper receiver 10 so as to communicate gas from the barrel 14 to the upper receiver 10, as is known in the art.

With reference to FIGS. 4-8, the barrel nut assembly 22 can include the barrel nut 32, a spring 48, a bushing 52, and a locking ring 54. The barrel nut assembly 22 can be made from a variety of materials without departing from the scope of this disclosure. Further, it will be appreciated that additional or less components than what are shown in the figures for the barrel nut assembly 22 could make up the barrel nut assembly 22. For example, it is envisioned that the barrel nut assembly 22 could include only the barrel nut 32 and the bushing 52. Further still, multiple components of the barrel nut assembly 22 could be integrally provided or as separate elements.

The barrel nut 32 can include a first end 32*a* and a second end 32*b* disposed at opposite terminal ends thereof. Further, the barrel nut 32 can include a shoulder 32*c*, an unlocked portion 32*d*, and a locked portion 32*e*. The shoulder 32*c* can be disposed at the first end 32*a* of the barrel nut 32. The first end 32*a* can include internal threads 56 for threaded engagement with the threaded boss 28 (FIG. 2) of the upper receiver 10 and the second end 32*b* can include external threads 58 for engagement with the locking ring 54 as will be described in more detail hereinafter.

The barrel nut 32 can also include a faceted outer surface 62 near the second end 32*b* for engagement with the bushing 52 as will be described in more detail hereinafter. For reference, the faceted outer surface 62 of the barrel nut 32 comprises the locked portion 32*e* and the non-faceted outer surface of the barrel nut 32 is the unlocked portion 32*d*.

The unlocked portion 32*d* of the outer surface 62 of the barrel nut 52 is unfaceted. The unlocked portion 32*d* defines an outer diameter of the barrel nut 52. It will be appreciated that the flat spot of the barrel nut 32 in the unlocked portion 32*d* is merely for application of a wrench to tighten the barrel nut 32 onto the upper receiver 10.

Figure 6B:
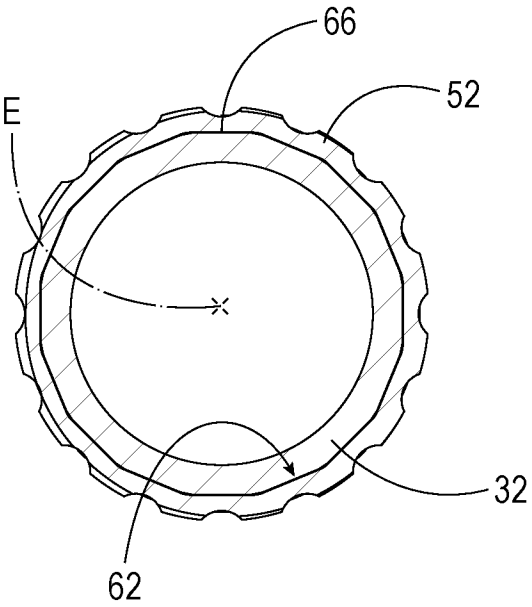
FIG. 6B is a sectional view of FIG. 6A along lines 6B-6B.
Figure 6A:
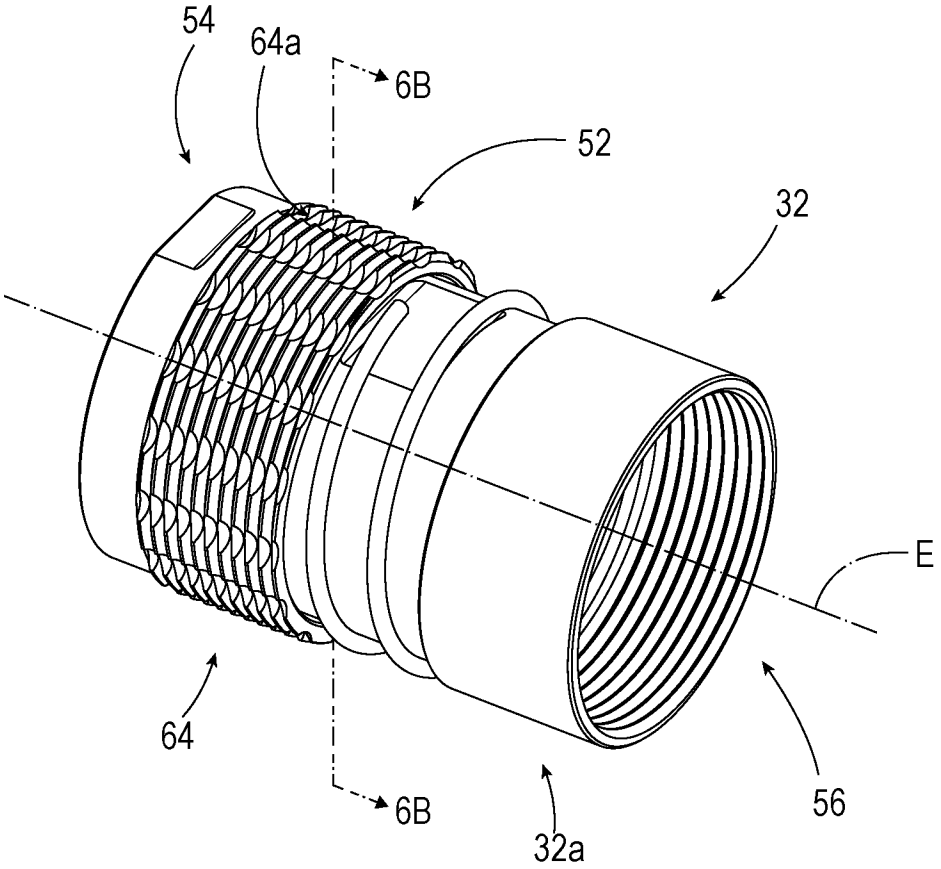
FIG. 6A is a perspective view of the barrel nut assembly in a locked position.
Figure 7B:
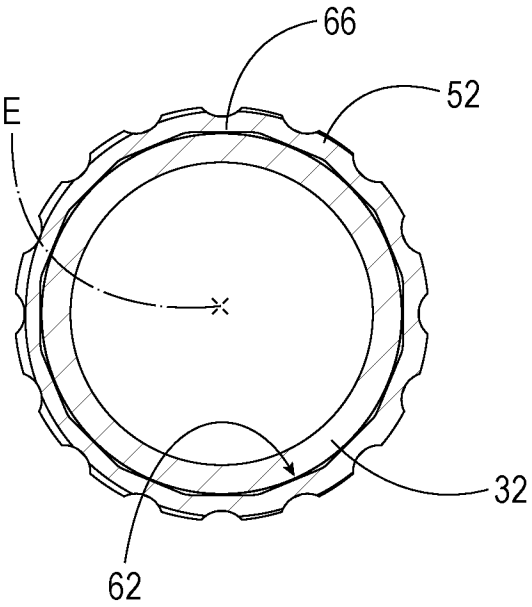
FIG. 7B is a sectional view of FIG. 7A along lines 7B-7B.
Figure 7A:
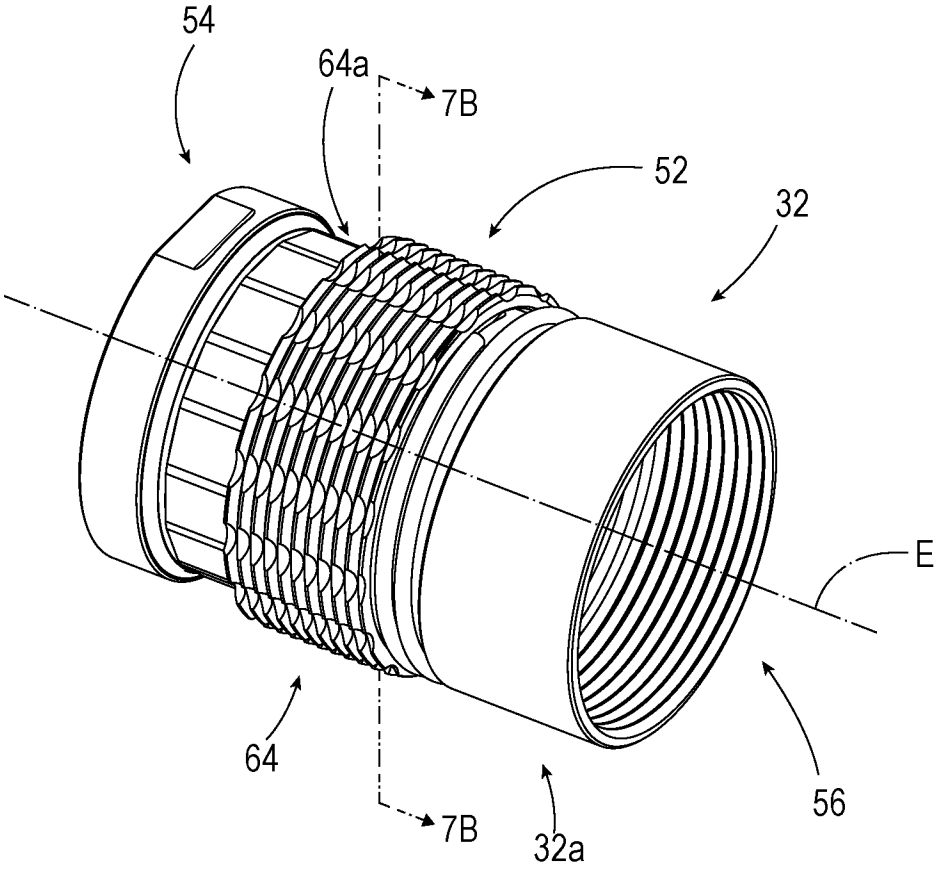
FIG. 7A is a perspective view of the barrel nut assembly in an unlocked position.
Figure 8:
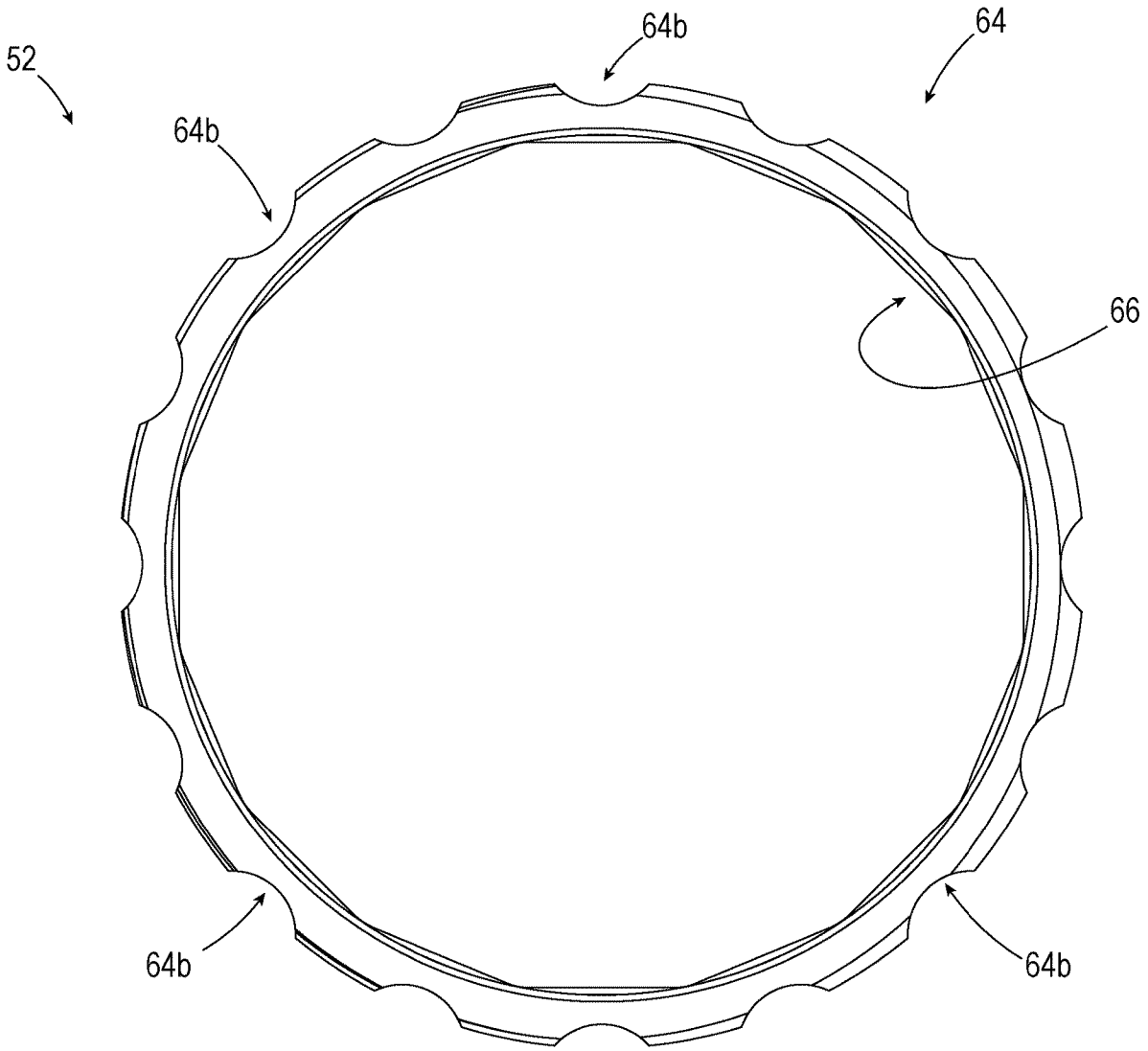
FIG. 8 is an elevation view of the bushing of the barrel nut assembly.

The bushing 52 can slidingly engage the barrel nut 32 so as to define an engagement axis E (FIGS. 6-7). As noted hereinbefore, the barrel nut 32 can include the locked portion 32*e* and the unlocked portion 32*d* along the engagement axis E. The bushing 52 can be rotatable about the engagement axis E on the barrel nut 32 when disposed on the unlocked portion 32*d* of the barrel nut 32 so as to define an unlocked position and not rotatable about the engagement axis E when disposed on the locked portion 32*e* of the barrel nut 32 so as to define a locked position. The bushing 52 can include a threaded outer diameter 64 for threaded engagement with the handguard 12.

Further still, the bushing 52 can include a faceted inner surface 66 for selective engagement with the faceted outer surface 62 of the barrel nut 32. As will be appreciated, the faceted inner surface 66 of the bushing 52 and the faceted outer surface 62 of the barrel nut 32 can have an equal number and shape of individual facets.

At least a portion of the inner surface 66 of the bushing 52 is faceted and the locked portion 32*e* of the barrel nut is faceted. Accordingly, the faceted inner surface 66 of the bushing 52 engages the faceted outer surface 62 of the barrel nut 32 when the bushing 52 is disposed on the locked portion 32*e* of the barrel nut 32 so as to prevent rotation between the bushing 52 and the barrel nut 32 about the engagement axis E. It will be appreciated that the term faceted in this disclosure means a non-smooth (i.e., non-circular cross-section) for engagement purposes.

Further, the threaded outer diameter 64 can include a leading thread 64*a* that serves as an initial point of threaded engagement with the handguard 12. As such, the leading thread 64*a* is selectively rotatable with respect to the barrel nut 32 about the engagement axis E. More specifically, the leading thread 64*a* of the bushing 52 is rotatable with respect to the barrel nut 32 about the engagement axis E when the faceted inner surface 66 of the bushing 52 is disposed on the unlocked portion 32*d* of the barrel nut 32. The leading thread 64*a* of the bushing 52 is not rotatable with respect to the barrel nut 32 about the engagement axis E when the faceted inner surface 66 of the bushing 52 is disposed on the locked portion 32*e* of the barrel nut 32.

As will also be appreciated, the faceted inner surface 66 of the bushing 52 has an overall perimeter that is greater than a perimeter of the faceted outer surface 62 of the barrel nut 32 so as to allow the barrel nut 32 to be received within the bushing 52 while also preventing rotation between the bushing 52 and the barrel nut 32. As illustrated, the faceted inner surface 66 of the bushing 52 and the faceted outer surface 62 of the barrel nut 32 may not linearly extend (i.e., the axis along which the barrel 14 primarily extends) along an entire outer surface of the respective bushing 52 and barrel nut 32, respectively.

This arrangement of only a portion of the respective outer surfaces of the bushing 52 and the barrel nut 32 including faceting allows for the bushing 52 to be slid towards the first end 32*a* of the barrel nut 32 (through the application of a compressive force by the user, thereby compressing the spring 48) to stop engagement between the faceted inner surface 66 of the bushing 52 and the faceted outer surface 62 of the barrel nut 32.

Thus, the bushing 52 can then be rotated with respect to the barrel nut 32, thereby allowing the location of the leading thread 64*a* of the bushing 52 to be adjusted. Once this rotation occurs, the compressive force by the user can be discontinued, thereby resulting in the bushing 52 moving away from the first end 32*a* of the barrel nut 32. Once this occurs, there can again be engagement between the faceted inner surface 66 of the bushing 52 and the faceted outer surface 62 of the barrel nut 32 so as to prevent rotation between the bushing 52 and the barrel nut 32.

The barrel nut assembly 22 can also include the spring 48 and the spring 48 can be disposed on the barrel nut 32. As illustrated, the spring 48 is a coil spring. However, other types and configurations of springs are possible and contemplated. The spring 48 can be retained on the barrel nut 32 by the shoulder 32*c* and the locking ring 54. The spring 48 slidably receives the barrel nut 32 and provides an expansive force between the barrel nut 32 and the bushing 52, thereby biasing the barrel nut 32 and the bushing 52 apart from one another so as to enhance connectivity between the components.

The spring 48 biases the bushing 52 to be disposed on the locked portion 32*e* of the barrel nut 32 to prevent rotation between the bushing 52 and the barrel nut 32 about the engagement axis E. Further, the spring 48 can be is compressible to allow the bushing 52 to move along the engagement axis E so that the bushing 52 is disposed on the unlocked portion 32*d* of the barrel nut 32 to allow rotation between the bushing 52 and the barrel nut 32 about the engagement axis E.

Additionally, the threaded outer diameter 64 can include a plurality of undercuts 64*b* that extend in a direction parallel to the engagement axis E. The undercuts 64*b* allow for passage of the gas tube 18. The locking ring 54 can include a threaded portion 68 disposed on an inner diameter of the locking ring 54 for threaded engagement with the external threads 58 of the barrel nut 32. Further, the locking ring outer diameter can be less than the bushing outer diameter 64. Such an arrangement allows for easy assembly of the barrel nut assembly 22.

Assembly of the system will now be described. First, the barrel 14 is slid through the locking ring 54, the bushing 52, the spring 48, and the barrel nut 32 and also inserted into the upper receiver 10. Then, the barrel nut 32 is tightened to the threaded boss 28 of the upper receiver 10. The bushing 52 can be rotated so that one undercut 64*b* is aligned with the gas port 26 with the leading thread 64*a* of the bushing 52 having a first rotational position. This alignment will allow the gas tube 18 to pass thereby and be inserted into the gas port 26.

Once this alignment occurs, the bushing 52 can be slid onto the barrel nut 32 so that the faceted inner surface 66 of the bushing 52 is aligned and is received by the faceted outer surface 62 of the barrel nut 32. Then, the locking ring 54 can threadingly engage the external threads 58 of the barrel nut 32. Next, the handguard 12 can threadingly engage the threaded outer diameter of the bushing 52 until the rear side 36*a* of the handguard 12 contacts the front face 34 of the upper receiver 10 and the rail portion 24 and the rail section 42 are continuous and also rotationally aligned.

If the rear side 36*a* of the handguard 12 does not contact the front face 34 of the upper receiver 10 or the rail portion 24 and the rail section 42 are not continuous or if they are not rotationally aligned, the handguard 12 can be unthreaded from the bushing 52 and removed. Then, because of the arrangement of only a portion of the respective outer diameters of the bushing 52 and the barrel nut 32 including faceting, the bushing 52 can be slid towards the first end 32*a* of the barrel nut 32 (i.e., compression of the spring 48) to stop engagement between the faceted inner surface 66 of the bushing 52 and the faceted outer surface 62 of the barrel nut 32. Then, the bushing 52 can be rotated with respect to the barrel nut 32, thereby changing the location of the leading thread 64*a* of the bushing 52.

Once this rotation occurs, the compressive force by the user can be discontinued and the bushing 52 will be biased by the spring 48 away from the first end 32*a* of the barrel nut 32, thereby resulting in engagement between the faceted inner surface 66 of the bushing 52 and the faceted outer surface 62 of the barrel nut 32 so as to prevent rotation between the bushing 52 and the barrel nut 32.

As such, no retorquing of the barrel nut 32 is required. Nor does the locking ring 54 have to be removed from the barrel nut 32. As such, the bushing 52 can be rotated with respect to the barrel nut 32 to another position in which another undercut 64*b* is aligned with the gas port 26 to allow the gas tube 18 to pass thereby and be inserted into the gas port 26 and the leading thread 64*a* is in a second rotational position.

As will be appreciated, the second rotational position is different from the first rotational position. Next, the handguard 12 can threadingly engage the threaded outer diameter of the bushing 52 until the rear side 36*a* of the handguard 12 contacts the front face 34 of the upper receiver 10 and the rail portion 24 and the rail section 42 are continuous and also rotationally aligned. The aforementioned process of compressing the spring 48 to allow for different rotational positions of the leading thread 64*a* with respect to the barrel nut 32 can be repeated until the desired position is obtained, all while not impacting the threaded connection between the upper receiver 10 and the barrel nut assembly 22.

The barrel nut assembly 22 of this disclosure allows the use of commonly available thread-on handguards already in the marketplace, while doing away with a variety of issues. These issues include undesirable gapping between the upper receiver 10 and the handguard 12, misalignment between the gas tube 18 and the gas port 26 of the upper receiver 10, and misalignment between the rail portion 24 and the rail section 42.

Notably, the barrel nut assembly 22 allows for the leading thread 64*a* to be rotationally adjusted to match with the needed geometrics specific to the individual firearm. Further, the barrel nut assembly 22 allows for thread-on handguards 12 which can have improved rigidity and better alignment with the barrel 14, as compared to a slide-on handguard. Further still, a sleek and aesthetic look is provided that lacks externally visible clamps or nuts/bolts by the present disclosure.

A barrel nut assembly has been described above in particularity. Modifications and alternations will occur to those upon reading and understanding the preceding detail description. The invention, however, is not limited to only the embodiment described above. Instead, the invention is broadly defined by the appended claims and the equivalents thereof.

The invention claimed is:

1. A barrel nut assembly of a firearm, the barrel nut assembly comprising:

a barrel nut configured for threaded attachment to an associated upper receiver of the firearm;

a bushing that slidingly engages the barrel nut, wherein the bushing threadingly engages an associated handguard of the firearm; and a spring that slidably receives the barrel nut to bias the barrel nut and the bushing apart from one another.

2. The barrel nut assembly of claim 1, further comprising a locking ring that includes a threaded portion disposed on an inner diameter thereof for threaded engagement with the barrel nut.

3. The barrel nut assembly of claim 2, wherein the locking ring defines a locking ring outer diameter and the bushing defines a bushing outer diameter, and wherein the locking ring outer diameter is less than the bushing outer diameter.

4. The barrel nut assembly of claim 2, the barrel nut including a first end and a second end disposed at opposite terminal ends thereof, wherein the first end defines internal threads for threaded engagement with an associated threaded boss of the associated upper receiver of the firearm and the second end of the barrel nut defines external threads for engagement with the locking ring.

5. The barrel nut assembly of claim 4, wherein the barrel nut includes a shoulder disposed at the first end, and wherein the spring is retained on the barrel nut by the shoulder and the locking ring.

6. The barrel nut assembly of claim 1, wherein the bushing defines an inner surface that selectively engages an outer surface of the barrel nut.

7. The barrel nut assembly of claim 6, wherein a least a portion of the inner surface of the bushing is faceted and a locked portion of the outer surface of the barrel nut is faceted.

8. A barrel nut assembly of a firearm, the barrel nut assembly comprising:

a barrel nut configured for threaded attachment to an associated upper receiver of the firearm; and a bushing that slidingly engages the barrel nut, wherein the bushing threadingly engages an associated handguard of the firearm, wherein the bushing slidingly engages the barrel nut so as to define an engagement axis and the barrel nut includes a locked portion and an unlocked portion along the engagement axis, wherein the bushing is rotatable about the engagement axis on the barrel nut when disposed on the unlocked portion of the barrel nut so as to define an unlocked position and not rotatable about the engagement axis when disposed on the locked portion of the barrel nut so as to define a locked position, and wherein the bushing defines an inner surface that selectively engages an outer surface of the barrel nut.

9. The barrel nut assembly of claim 8, wherein a least a portion of the inner surface of the bushing is faceted and the locked portion of the outer surface of the barrel nut is faceted.

10. The barrel nut assembly of claim 9, wherein the faceted inner surface of the bushing engages the faceted outer surface of the barrel nut when the bushing is disposed on the locked portion of the barrel nut so as to prevent rotation between the bushing and the barrel nut about the engagement axis.

11. The barrel nut assembly of claim 9, wherein the unlocked portion of the outer surface of the barrel nut is unfaceted and defines an outer diameter of the barrel nut.

12. The barrel nut assembly of claim 9, further including a spring disposed on the barrel nut, wherein the spring biases the bushing to be disposed on the locked portion of the barrel nut to prevent rotation between the bushing and the barrel nut about the engagement axis.

13. The barrel nut assembly of claim 12, wherein the spring can be is compressible to allow the bushing to move along the engagement axis so that the bushing is disposed on the unlocked portion of the barrel nut to allow rotation between the bushing and the barrel nut about the engagement axis.

14. The barrel nut assembly of claim 8, further including a spring that slidably receives the barrel nut to bias the barrel nut and the bushing apart from one another.

15. A barrel nut assembly of a firearm, the barrel nut assembly comprising:

a barrel nut configured for threaded attachment to an associated upper receiver of the firearm; and a bushing that slidingly engages the barrel nut, wherein the bushing threadingly engages an associated handguard of the firearm, wherein the bushing defines a threaded outer diameter that threadingly engages the associated handguard of the firearm and the bushing slidingly engages the barrel nut so as to define an engagement axis, wherein the threaded outer diameter of the bushing includes a leading thread that serves as an initial point of threaded engagement with the associated handguard, wherein the threaded outer diameter of the bushing defines a plurality of undercuts that extend in a direction parallel to the engagement axis, and wherein the plurality of undercuts allow for passage of an associated gas tube of the firearm.

16. The barrel nut assembly of claim 15, wherein the leading thread of the bushing is selectively rotatable with respect to the barrel nut about the engagement axis.

17. The barrel nut assembly of claim 16, wherein the barrel nut includes a locked portion and an unlocked portion along the engagement axis, and wherein the leading thread of the bushing is rotatable with respect to the barrel nut about the engagement axis when a faceted inner surface of the bushing is disposed on the unlocked portion of the barrel nut and the leading thread of the bushing is not rotatable with respect to the barrel nut about the engagement axis when the faceted inner surface of the bushing is disposed on the locked portion of the barrel nut.

18. The barrel nut assembly of claim 15, wherein the bushing defines an inner surface that selectively engages an outer surface of the barrel nut.

19. The barrel nut assembly of claim 18, wherein a least a portion of the inner surface of the bushing is faceted and a locked portion of the outer surface of the barrel nut is faceted.

20. The barrel nut assembly of claim 15, further including a spring that slidably receives the barrel nut to bias the barrel nut and the bushing apart from one another.

* * * * *